United States Patent [19]

Harvey

[11] 4,123,683

[45] Oct. 31, 1978

[54] ELONGATED CROSSED-FIELD SWITCH DEVICE

[75] Inventor: Robin J. Harvey, Thousand Oaks, Calif.

[73] Assignee: Hughes Aircraft Company, Culver City, Calif.

[21] Appl. No.: 833,527

[22] Filed: Sep. 15, 1977

[51] Int. Cl.[2] ..... H01J 1/50

[52] U.S. Cl. ..... 313/156; 313/161

[58] Field of Search ..... 313/156, 161

[56] References Cited

U.S. PATENT DOCUMENTS 3,906,270 9/1975 Gallagher et al. ..... 313/157

*Primary Examiner*—Rudolph V. Rolinec
*Assistant Examiner*—Darwin R. Hostetter
*Attorney, Agent, or Firm*—Allen A. Dicke, Jr.; W. H. MacAllister

[57] ABSTRACT

Crossed-field switch device has a continuous elongated closed path active plasma discharge region between adjacent electrodes. A magnet produces a magnetic field at an angle to the electric field to define the elongated active region in the interelectrode space where glow mode discharge occurs. The electrodes and magnetic field are shaped so that the glow mode discharge in the active region is elongated.

11 Claims, 5 Drawing Figures

ELONGATED CROSSED-FIELD SWITCH DEVICE

BACKGROUND

This invention is directed to a crossed-field switch device in which the geometry of the magnetic field and the electrodes is such that the active region in which glow mode discharge occurs is in a noncircular path.

The original Penning work on glow mode discharge in an interelectrode space where the magnetic field is at an angle to the electric field evolved to the structure of U.S. Pat. No. 2,182,736. A considerable amount of recent development work has been done at the Research Laboratories of Hughes Aircraft Company to develop a device having crossed-field low pressure glow mode discharge into a switch device which is capable of off-switching large current against high voltage. The off-switching speed is so rapid that off-switching can occur between the natural current zeroes of the usual 60 Hertz power line. While the off-switching device is very important for direct current off-switching, it is also applicable to rapid off-switching of power line alternating current between natural current zeroes. General background along these lines is illustrated in G. A. G. Hofmann U.S. Pat. No. 3,604,977 as well as in H. E. Gallagher and W. Knauer U.S. Pat. No. 3,963,960.

In order to maintain a glow discharge in an interelectrode space, the path of an electron as it moves from one electrode to another through the gas in the interelectrode region must be sufficiently long that cascading ionization occurs. In other words, statistically each electron must have enough collisions to produce more than one ionizing collision. The maintenance of gas pressure and the lengthening of the effective electron path between the electrodes by the application of the crossed magnetic field is discussed in G. A. G. Hoffmann and R. C. Knechtli U.S. Pat. No. 3,558,960; M. A. Lutz and R. C. Knechtli U.S. Pat. No. 3,638,061; R. E. Lund and G. A. G. Hofmann U.S. Pat. No. 3,641,384; and G. A. G. Hofmann U.S. Pat. No. 3,769,537. Each of these patents shows the Paschen curve of voltage vs. the product $pd$ where $p$ is pressure and $d$ is the dimension of the interelectrode space. These curves are for a particular gas and zero magnetic field. The curves define regions between conductive and nonconductive conditions. They show that for a particular value of the product $pd$, the voltage at which breakdown into the glow mode occurs is at a minimum.

M. A. Lutz and G. A. G. Hofmann U.S. Pat. No. 3,678,289 discusses off-switching and discusses the characteristics of the glow mode discharge which permit off-switching. The patent shows in FIG. 3 a curve of the applied voltage across the interelectrode space vs. the magnetic field in the interelectrode space and shows the relationships of these parameters in which glow mode discharge does and does not occur, for fixed values of the product $pd$ and for a particular gas.

It is apparent in these structures that the anode and cathode electrodes are of cylindrical nature and lie on a common axis to provide a cylindrical interelectrode space of substantially constant spacing $d$. This configuration evolved both because of the mechanical reasons of convenience in forming electrodes as surfaces of revolution around their axes and the desirability of cylindrical structure as pressure vessels, because the cathode electrode or its housing must withstand substantially atmospheric pressure. In addition, the designers of such equipment felt that the active plasma region or discharge path in addition to being continuous must also be a smooth circular curve to maintain the glow discharge characteristics in the active region. These design criteria limit the amount of effective electrode area because of the difficulty of constructing very large cylindrical structures with the electrodes accurately spaced. These problems are overcome by the invention of the present asymmetric crossed-field switch device and the discovery that the active region glow discharge continuous path need not be circular.

SUMMARY

In order to aid in the understanding of this invention, it can be stated in essentially summary form that it is directed to an asymmetric crossed-field switch device which has spaced anode and cathode electrodes which define an interelectrode space in which crossed electric and magnetic fields are produced. The gas in the space forms a glow discharge in the active region. The active region in which the discharge takes place is elongated and noncircular.

It is thus an object of this invention to provide a crossed-field switch device in which a long discharge path is produced in an active region to provide substantial electrode area so that larger current can be switched in a physically smaller device. It is another object to provide an asymmetric crossed-field switch device wherein the plasma discharge space between the facing electrodes is asymmetric about a geometric axis of the shape of the electrode surfaces.

Other objects and advantages of this invention will become apparent from the study of the following portion of this specification, the claims and the attached drawings.

DESCRIPTION OF THE PREFERRED EMBODIMENT

Figure 1:
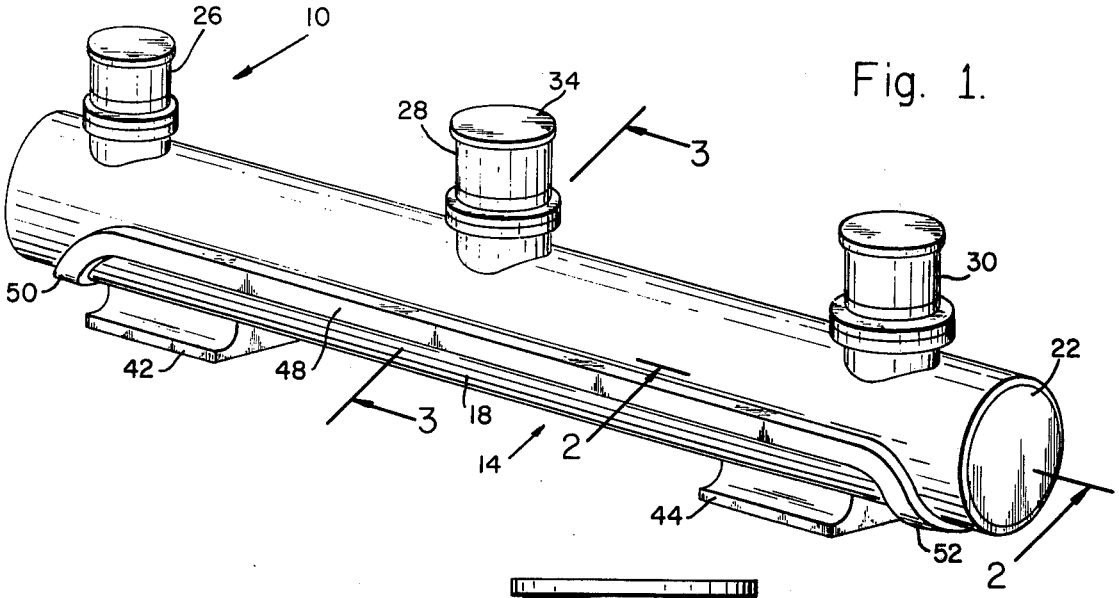
FIG. 1 is a perspective view of an asymmetric crossed-field switch device.
Figure 2:
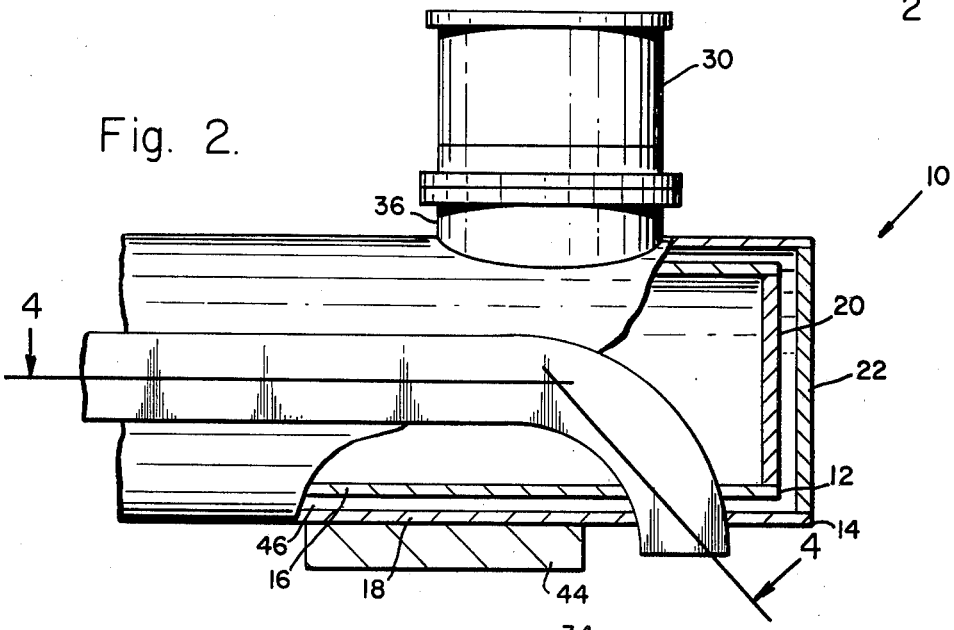
FIG. 2 is an enlarged side elevational view thereof, as seen along line 2—2 of FIG. 1, with parts broken away and parts taken in section.
Figure 3:
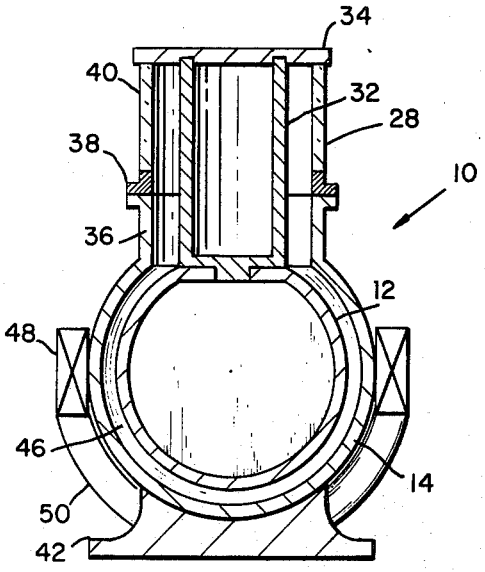
FIG. 3 is an enlarged section taken generally along line 3—3 of FIG. 1.

The crossed-field switch device of this invention is generally indicated at 10 in each of FIGS. 1, 2, 3, and 4. Crossed-field switch device 10 has a central anode electrode 12 and outer cathode electrode 14. Each of these electrodes is formed with a cylindrically tubular central section, as shown at 16 and 18, and is capped by end caps 20 and 22 on the right end and similar caps on the left end. The caps shown are flat planes on the diameter, but hemispherical convex caps can be used. Hemispherical end caps cause greater problems in maintaining electrode spacing.

Anode electrode 12 is spaced within cathode electrode 14 and supported therein by means of insulator towers 26, 28 and 30. Insulator tower 28 is shown in transverse section in FIG. 3, and the other towers are identical. In addition to providing mechanical support for the anode electrode they provide for electrical connection thereto. Connector 32 is secured to the top of anode 12 and extends upward therefrom. In the present case, it has a nose which extends into an opening in the anode and is secured therein by welding. Connector 32 is metallic and is secured to cover plate 34. Thus, cover plate 34 is electrically connected to the anode for external electrical connection thereto. If desired, added current can be distributed by connection to the cover plates of each of the insulator towers.

Tubular boss 36 extends upward from cathode 14. Flanges 38 provides the opportunity for opening the insulator tower. Above flange 38 is cylindrical tubular insulator bushing 40 which is secured to the flange and to the underside of cover plate 34. By means of insulator bushing 40, the cover plate is insulated from cathode 14. In this way, the insulator towers rigidly position anode electrode 14 within cathode electrode 12 to maintain interelectrode space 46. Electrical connection to the cathode is provided by support feet 42 and 44.

Several conditions are necessary to satisfy the maintenance of a plasma. These include the physical criteria of gas type, gas pressure, interelectrode spacing *d*, electrical field strength and magnetic field strength along the closed path which constitutes the active region. The conditions also include the dimensional characteristics of the closed path and the adjacent electrodes. The relationship of area-to-current is as follows:

$$A \geqq I/3$$

where $A$ is the area in square centimeters of the active region of the electrodes, and $I$ is the electrode current in amperes. The active region is the region where there is sustained plasma activity during conduction.

Another important criterion is the length or the perimeter of the active region. The relationship between the total active region path length perimeter and the current can be generally expressed as follows:

$$P > I/40$$

where $P$ is active region path length or perimeter in centimeters and $I$ is the current in amperes. This relationship results from effect of the magnetic field resulting from the conducted current. If the current increases more than about that value, then the current will produce a magnetic field which has an adverse effect on the plasma. If this value of current is exceeded, the plasma is driven around the corner, above or below that portion of the electrode area which is considered to be the active portion or area away from the strong magnetic field.

Figure 4:
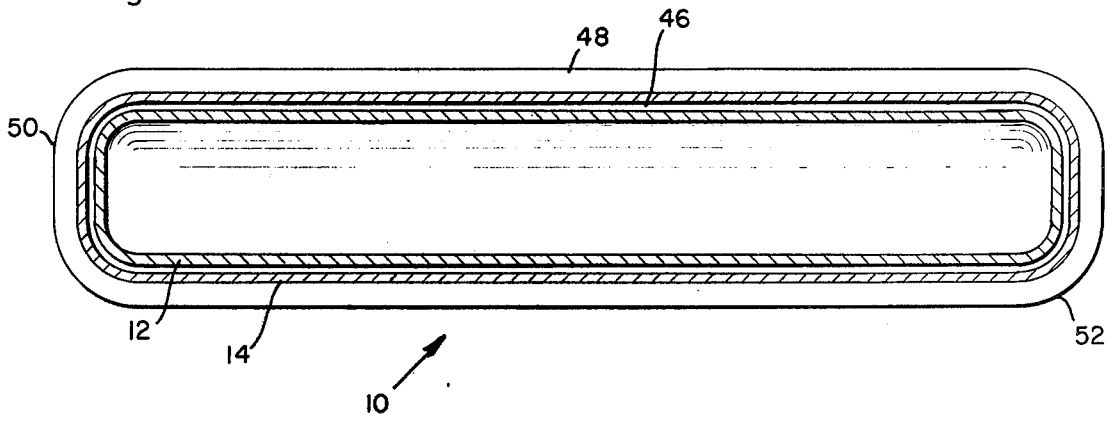
FIG. 4 is a reduced section taken generally along the magnetic field coil.

Another requirement is that the path along its length must have smooth corners and turns rather than sharp corners. If sharp corners are present, then the plasma tends to become overly dense in the corners due to the discontinuity of the otherwise uniform electric and magnetic fields in the active region of the interelectrode space. In FIG. 4, the section through the crossed-field switch device 10 is a section along the shape of magnetic field coil 48 showing the interelectrode space 46 in the active region. The active region is defined by the region where the magnetic field produced by a magnet 48, together with the electric field produces a plasma. Even though the interelectrode space *d* and the electric field are the same through the entire device 10, the closed path in the interelectrode space represented by the FIG. 4 section is the one in which plasma occurs because of the presence of the magnetic field. In FIG. 4, this is shown to be a pair of long straight paths circularly connected at each end.

Figure 5:
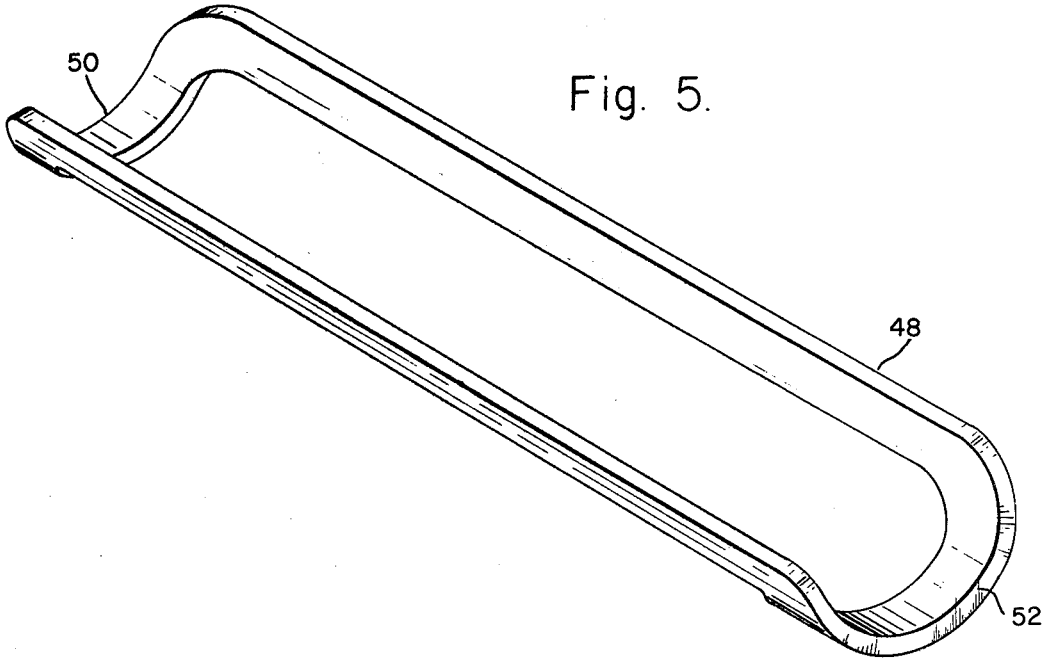
FIG. 5 is a perspective view of the magnetic field coil.

FIG. 5 shows the configuration of magnetic field winding 48. It is straight along the main length of tubes 16 and 18. Adjacent each end of the tubes it curves down and ducks under the tubes. The curved portions of coil 48 are shown at 50 and 52. These curves cause the rounded ends of the path shown in FIG. 4. This configuration is easier to structure than electrodes with hemispherical ends but results in the same shape of active plasma discharge region. The coil need not lie in a plane, but the coil shape in conjunction with the shape of the interelectrode space defines the continuous elongated shape of the active plasma region.

Other electrode arrangements which provide a closed path without sharp corners, even though they are noncircular but are elongated are feasible as configuration for the plasma path as long as the construction also meets the other criteria.

This invention having been described in its preferred embodiment, it is clear that it is susceptible to numerous modifications and embodiments within the ability to those skilled in the art and without the exercise of the inventive faculty. Accordingly, the scope of this invention is defined by the scope of the following claims.

What is claimed is:

1. A crossed-field switch device comprising:

an anode electrode and a cathode electrode spaced from each other to define an interelectrode space so that a selected gas at a selected pressure can occupy the space, said electrodes being electrically isolated so that application of voltage between said electrodes results in an electric field which is oriented in a direction between said electrodes across the space, magnetic field means for providing a magnetic field in the interelectrode space to define an active region in the interelectrode space where the magnetic field is substantially perpendicular with respect to the electric field so that electrons traverse a closed path in the active region to cause cascading ionization which results in self-sustaining plasma and interelectrode electrical conduction, the improvement comprising:

the path of the active region in the interelectrode space being configured with an elongated shape having greater length than width to reduce the overall width as compared to a circular path having the same length.

2. The crossed-field switch device of claim 1 wherein the path lies adjacent said magnetic field means.

3. The crossed-field switch device of claim 2 wherein said electrodes are straight cylindrical tubes and said elongated region is shaped to lie adjacent the surface of said straight electrode tubes.

4. The crossed-field switch device of claim 1 wherein said anode and cathode electrodes each have a substantially circular cross section in a plane substantially perpendicular to the path of the active region.

5. The crossed-field switch device of claim 4 wherein said anode and cathode electrodes are cylindrical about an axis substantially parallel to said plane parallel to the electric field.

6. The crossed-field switch device of claim 5 wherein said cylinders are terminated at their ends by substantially flat end caps which are spaced from each other by substantially the same interelectrode spacing and the active region passes around a circumference of said electrodes.

7. A crossed-field switch device comprising:

anode and cathode electrodes spaced from each other and defining an interelectrode space, means for providing an electric field across the interelectrode space substantially normal to the electrode surfaces defining said interelectrode space, means for providing a selected gas at a selected pressure in said interelectrode space, the improvement comprising:

means for providing a magnetic field in a portion of said interelectrode space substantially perpendicular to the electric field to define an active region of the interelectrode space in which plasma occurs along a smooth continuous closed path which has a narrower outline than a circular path of the same length.

8. The switch device of claim 7 wherein the surface of the cathode electrode adjacent the active plasma region has an area in centimeters at least three times the conductive current in amperes.

9. The crossed-field switch device of claim 7 wherein the length of the closed path in centimeters is at least 40 times greater than the conducted current in amperes.

10. The crossed-field switch device of claim 8 wherein the length of the closed path in centimeters is at least 40 times greater than the conducted current in amperes.

11. The crossed-field switch device of claim 7 wherein the continuous closed path has smooth corners and turns therein.

* * * * *